US008646279B2

(12) United States Patent
Schreiber et al.

(10) Patent No.: US 8,646,279 B2
(45) Date of Patent: Feb. 11, 2014

(54) SEGMENT COMPONENT IN HIGH-TEMPERATURE CASTING MATERIAL FOR AN ANNULAR COMBUSTION CHAMBER, ANNULAR COMBUSTION CHAMBER FOR AN AIRCRAFT ENGINE, AIRCRAFT ENGINE AND METHOD FOR THE MANUFACTURE OF AN ANNULAR COMBUSTION CHAMBER

(75) Inventors: Karl Schreiber, Am Mellensee (DE); Miklos Gerendas, Am Mellensee (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 0 days.

(21) Appl. No.: 13/480,696

(22) Filed: May 25, 2012

(65) Prior Publication Data

US 2012/0304658 A1 Dec. 6, 2012

(30) Foreign Application Priority Data

May 25, 2011 (DE) ..... 10 2011 076 473

(51) Int. Cl.
*F02C 3/06* (2006.01)
*F02C 1/00* (2006.01)
*F02G 3/00* (2006.01)

(52) U.S. Cl.
USPC ..... 60/804; 60/752

(58) Field of Classification Search
USPC ..... 60/752, 754–758, 760, 804
See application file for complete search history.

(56) References Cited

U.S. PATENT DOCUMENTS

| | | | | |
|---|---|---|---|---|
| 2,821,066 | A * | 1/1958 | Clarke et al. | 60/748 |
| 5,279,127 | A * | 1/1994 | Napoli | 60/754 |
| 5,964,091 | A * | 10/1999 | Fukui et al. | 60/752 |
| 7,243,426 | B2 | 7/2007 | Schreiber et al. | |
| 7,322,196 | B2 | 1/2008 | Tiemann | |
| 7,942,004 | B2 * | 5/2011 | Hodder | 60/752 |
| 2004/0250549 | A1 | 12/2004 | Liebe | |
| 2007/0062198 | A1 * | 3/2007 | Huth et al. | 60/752 |
| 2007/0113558 | A1 * | 5/2007 | Brown et al. | 60/752 |
| 2011/0000890 | A1 | 1/2011 | Arjakine et al. | |

FOREIGN PATENT DOCUMENTS

| | | |
|---|---|---|
| DE | 19959292 | 6/2001 |
| EP | 1106927 | 6/2001 |
| EP | 1312865 | 5/2003 |
| EP | 1422479 | 5/2004 |
| WO | 2004/106809 | 12/2004 |
| WO | 2009/109409 | 9/2009 |

OTHER PUBLICATIONS

Nickel based superalloy welding practices for industrial gas turbine applications Authors: Henderson, M. B.; Arrell, D.; Larsson, R.; Heobel, M.; Marchant, G. Source: Science and Technology of Welding & Joining, vol. 9, No. 1, Feb. 2004 , pp. 13-21(9).*

* cited by examiner

*Primary Examiner* — Phutthiwat Wongwian
*Assistant Examiner* — William Breazeal
(74) *Attorney, Agent, or Firm* — Timothy J. Klima; Shuttleworth & Ingersoll, PLC

(57) ABSTRACT

The present invention relates to a segment component in high-temperature casting material for an annular combustion chamber of an aircraft engine, characterized by a combustion-chamber wall which in operation shields a fuel flame extending along a burner axis from the environment, with the combustion-chamber wall having a bulge which points in a direction facing away from the burner axis. The invention furthermore relates to an annular combustion chamber, an aircraft engine with an annular combustion chamber as well as a method for the manufacture of an annular combustion chamber.

15 Claims, 8 Drawing Sheets

Figure 1:
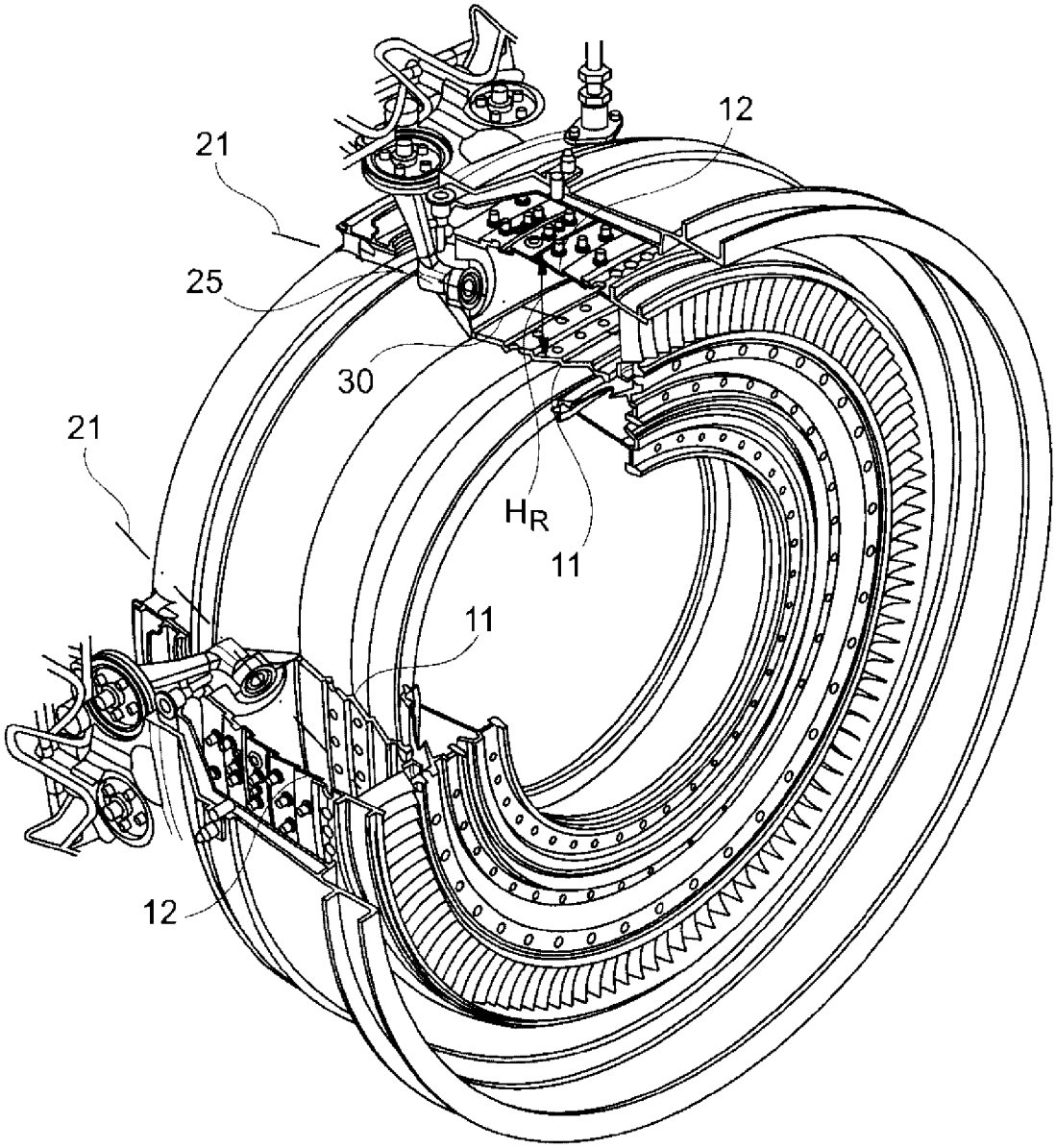

SEGMENT COMPONENT IN HIGH-TEMPERATURE CASTING MATERIAL FOR AN ANNULAR COMBUSTION CHAMBER, ANNULAR COMBUSTION CHAMBER FOR AN AIRCRAFT ENGINE, AIRCRAFT ENGINE AND METHOD FOR THE MANUFACTURE OF AN ANNULAR COMBUSTION CHAMBER

This application claims priority to German Patent Application DE102011076473.9 filed May 25, 2011, the entirety of which is incorporated by reference herein.

This invention relates to a segment component in high-temperature casting material for an annular combustion chamber, an annular combustion chamber for an aircraft engine, an aircraft engine and a method for the manufacture of an annular combustion chamber.

Modern aircraft engines usually have annular combustion chambers arranged axially between the compressor and the turbine. An annular combustion chamber has, coaxially to the engine longitudinal axis, an annular space delimited by combustion-chamber walls and referred to as flame tube. The injectors for the fuel are arranged along the annular cross-section of the annular space. In operation, the fuel flames extend from these injectors into the annular space.

Due to the high thermal loads, the combustion-chamber walls must be designed with adequate thermal stability. It is known for example, to equip the combustion-chamber walls with particularly thermo-resistant plates. A method is known from EP 1 106 927 according to which the annular space of an annular combustion chamber is made up of individual segments of casting material, with high-temperature casting materials being used.

The object underlying the present invention is to provide segment components for annular combustion chambers which are thermically and fluidically improved.

It is an object of the present invention to provide a solution to the above problems by a segment component having features as described herein.

In this case, a combustion-chamber wall which in operation shields a fuel flame extending along a burner axis from the environment has a bulge which points in a direction facing away from the burner axis. A part of a segment component for an outer combustion-chamber wall of an annular combustion chamber has for example a bulge pointing radially outwards. A part of a segment component for an inner combustion-chamber wall has for example a bulge which points outwards. The bulges create in the immediate vicinity of the burner flame a larger space, in that the spacing of the combustion-chamber walls is increased in at least some areas around the burner flame.

It is advantageous here to use an inner combustion-chamber wall and an outer combustion-chamber wall, between which a fuel flame is provided along a burner axis in operation, and which for example feature a U-shaped arrangement. The inner and/or the outer combustion-chamber wall then have a bulge in the direction pointing away from the burner axis.

It is particularly advantageous here when the at least one bulge of the combustion-chamber wall is adapted substantially to the contour of the fuel flame in operation. The length and/or width of the bulge can here advantageously correspond substantially to the length and/or width of the fuel flame in operation.

Advantageous high-temperature casting materials are a super-alloy containing nickel, chromium, cobalt and/or nickel-iron, in particular Inconel 738/Inconel 738 LC, Inconel 939/Inconel 939 LC, Inconel 713/Inconel 713 LC, C1023, Mar M 002 and/or CM 274LC. These materials have a sufficient temperature resistance.

In an advantageous embodiment, the inner combustion-chamber wall and the outer combustion-chamber wall are connected to one another in one piece as a casting by a combustion-chamber head, or the inner combustion-chamber wall and the outer combustion-chamber wall are connected to a combustion-chamber head. In the first variant, one-piece segment components are provided, and in the second variant two segment components connected to one another are provided.

An advantageous embodiment is obtained when at least one mounting flange is arranged on the combustion-chamber head. It is furthermore advantageous when a device for arranging an injector for fuel is provided on the combustion-chamber head. At least one nozzle for cooling air integrally formed onto a combustion-chamber wall can also be advantageously provided.

The combustion-chamber wall advantageously has in one embodiment a mean thickness between 1 and 4 mm, in particular 1.4 to 3 mm.

The problem is resolved by providing an annular combustion chamber for an aircraft engine having the features of Claim 9. For this purpose at least two segment components in accordance with at least one of the Claims 1 to 8 are used.

Advantageous embodiments of the annular combustion chamber have a variable annular space height along the circumference of the annular space. By adapting the annular space height to, for example, burner flames and/or injectors, the thermal and/or mechanical load of the walls can be attained. This applies in particular when areas A with a greater annular space height $H_{RA}$ alternate with areas B with a lower annular space height $H_{RB}$ along the circumference, such that the combustion-chamber walls form a kind of wavelike structure.

It is particularly advantageous here when areas with a greater annular space height and areas with a lower annular space height are formed, where during assembly injectors for the fuel are provided in the areas with the greater annular space height. The areas with greater annular space height give the fuel flame more space and shield it from disturbances inside the annular space.

Furthermore, the segment components are in advantageous embodiments connected to one another by welds, in particular electron beam welds, laser welds with IN626 Filler, Polymet 972 or other ductile filler materials.

The problem is also resolved by providing an aircraft engine with an annular combustion chamber in accordance with the Claims 11 to 14. The entire flow from the compressor via the combustion chamber to the turbine is improved by the bulges arranged around the flames.

Furthermore, the problem is resolved by a method for the manufacture of an annular combustion chamber.

In one embodiment, at least two segment components are cast with an inner combustion-chamber wall, an outer combustion-chamber wall and a combustion-chamber head from high-temperature casting material. The at least two segment components are subsequently connected by joining them, in particular by welding, to the annular combustion chamber.

Alternatively, at least two segment components are connected, in particular welded, to form an inner full ring structure. At least two segment components are connected, in particular welded, to form an outer full ring structure. The present full ring structures are connected to a combustion-chamber head structure.

Figure 2:
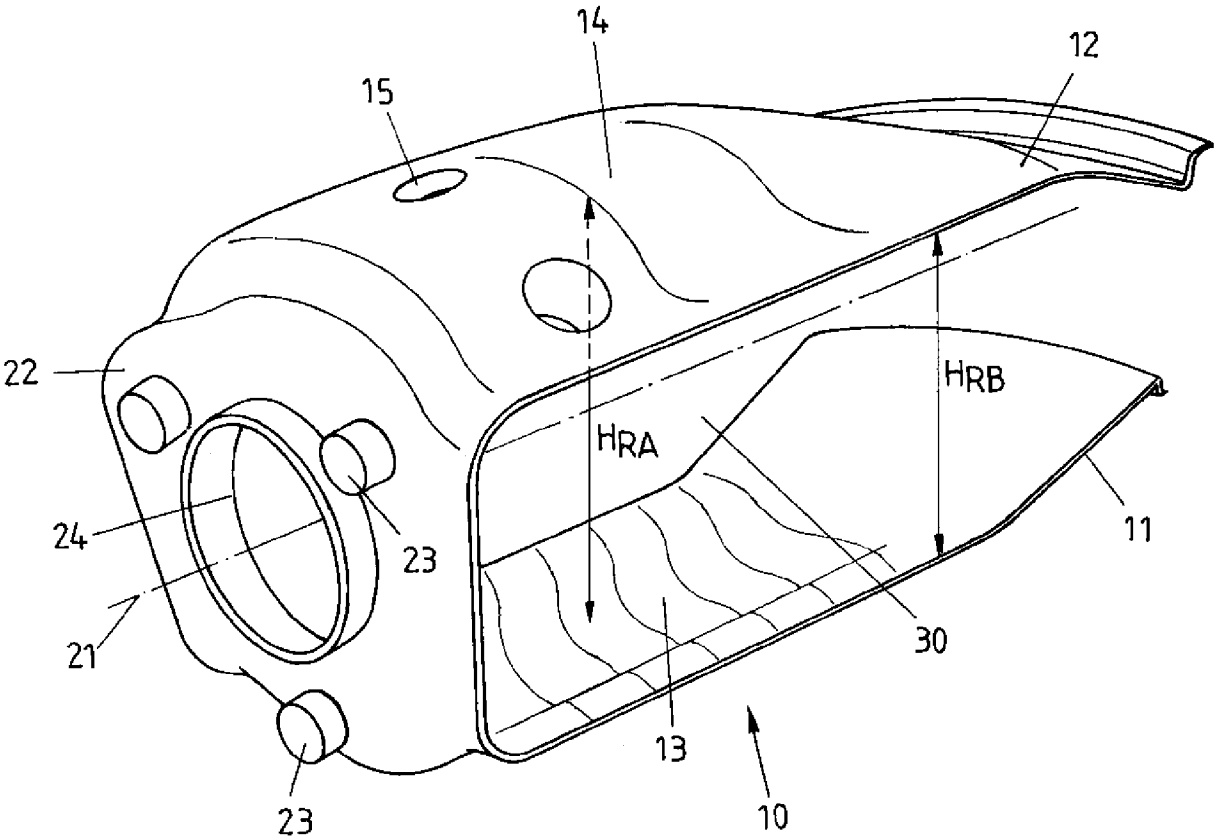
Figure 2A:
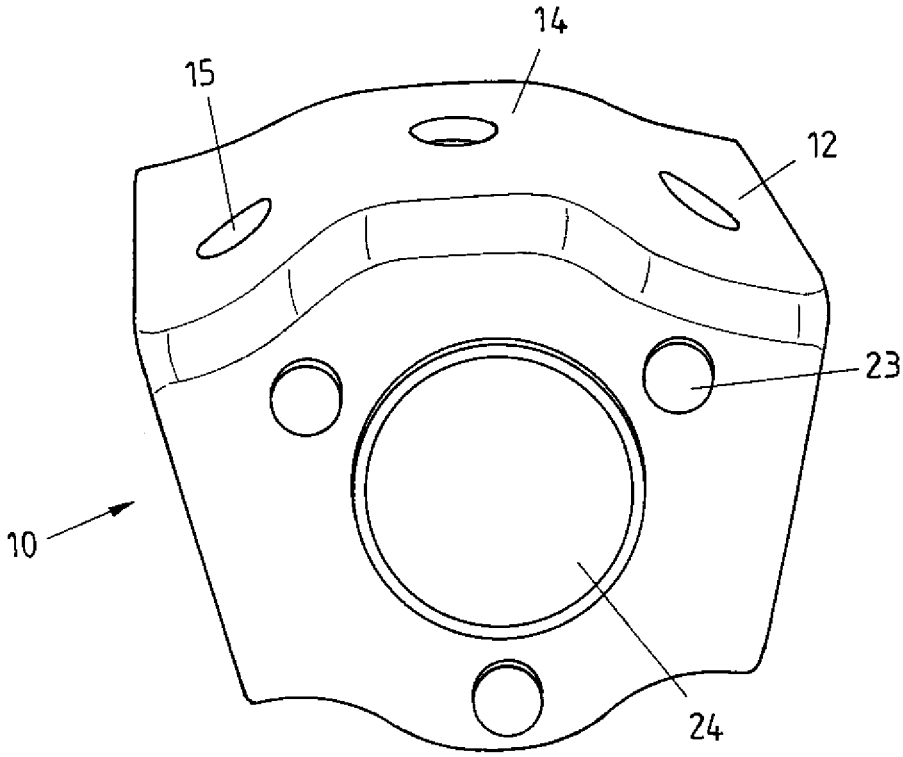
Figure 2B:
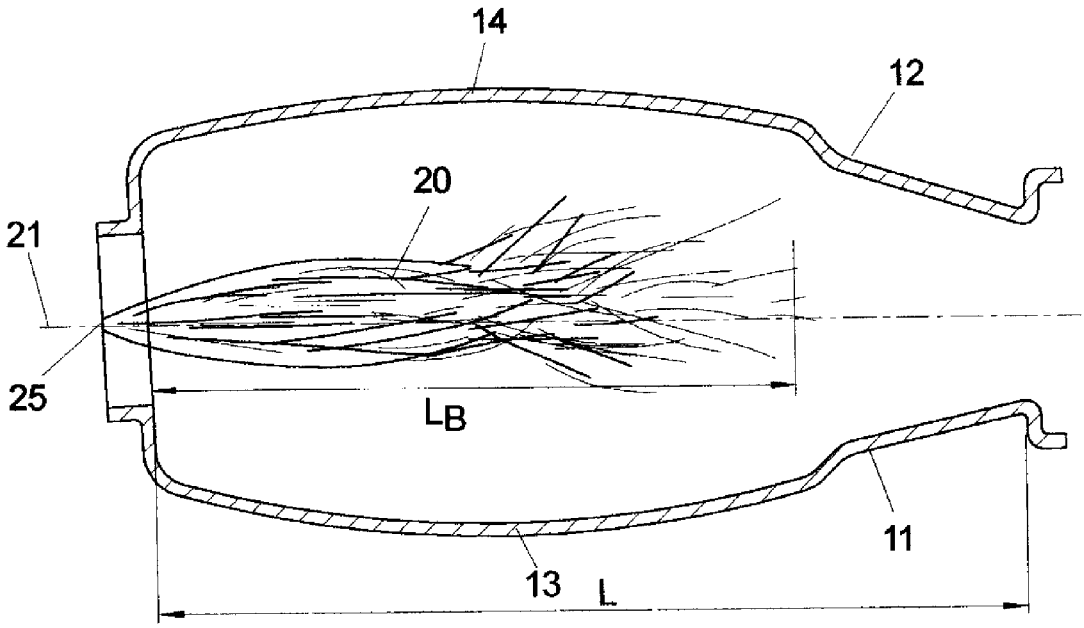
Figure 2C:
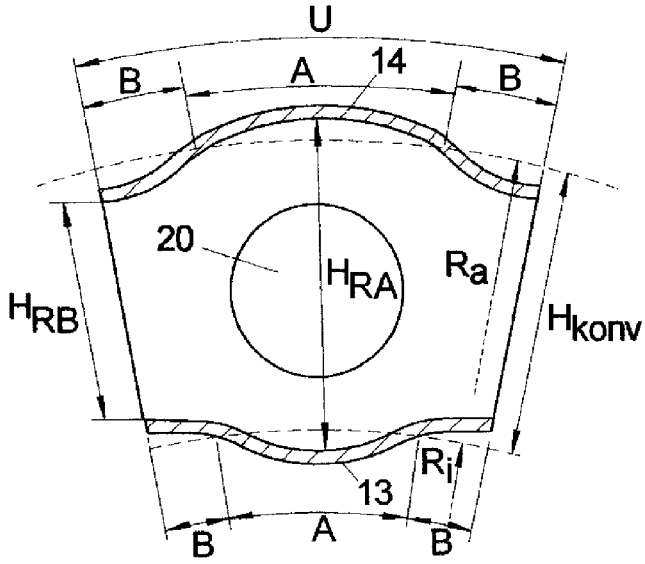
Figure 3:
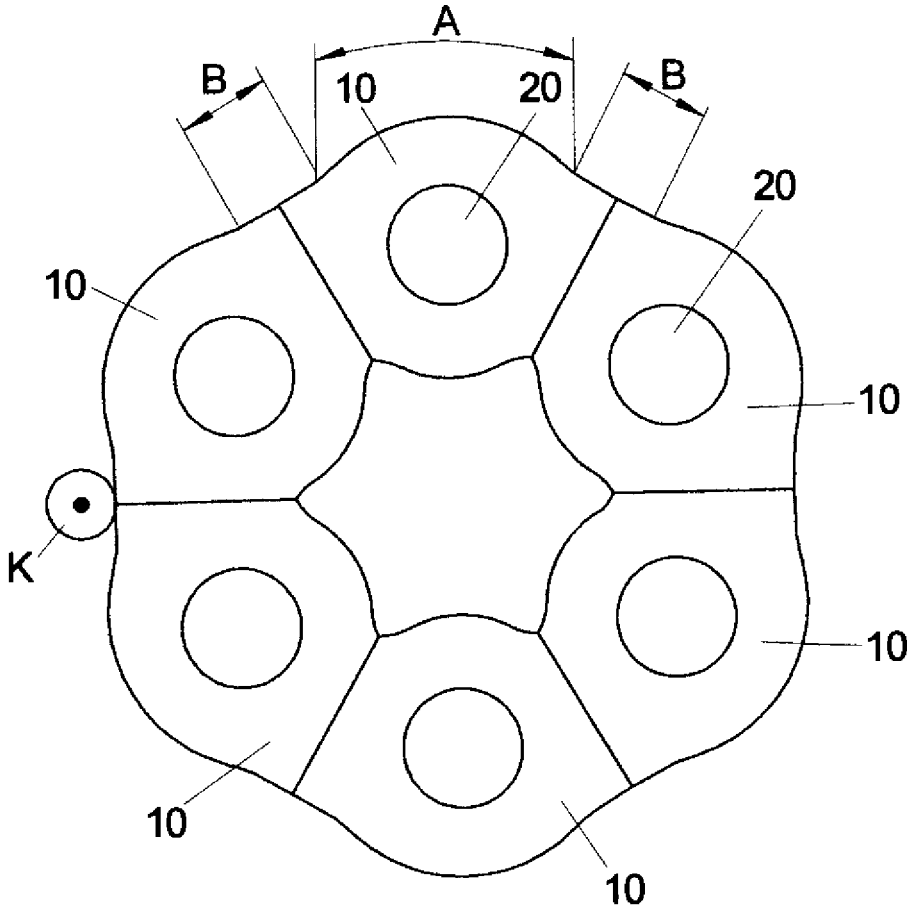
Figure 4:
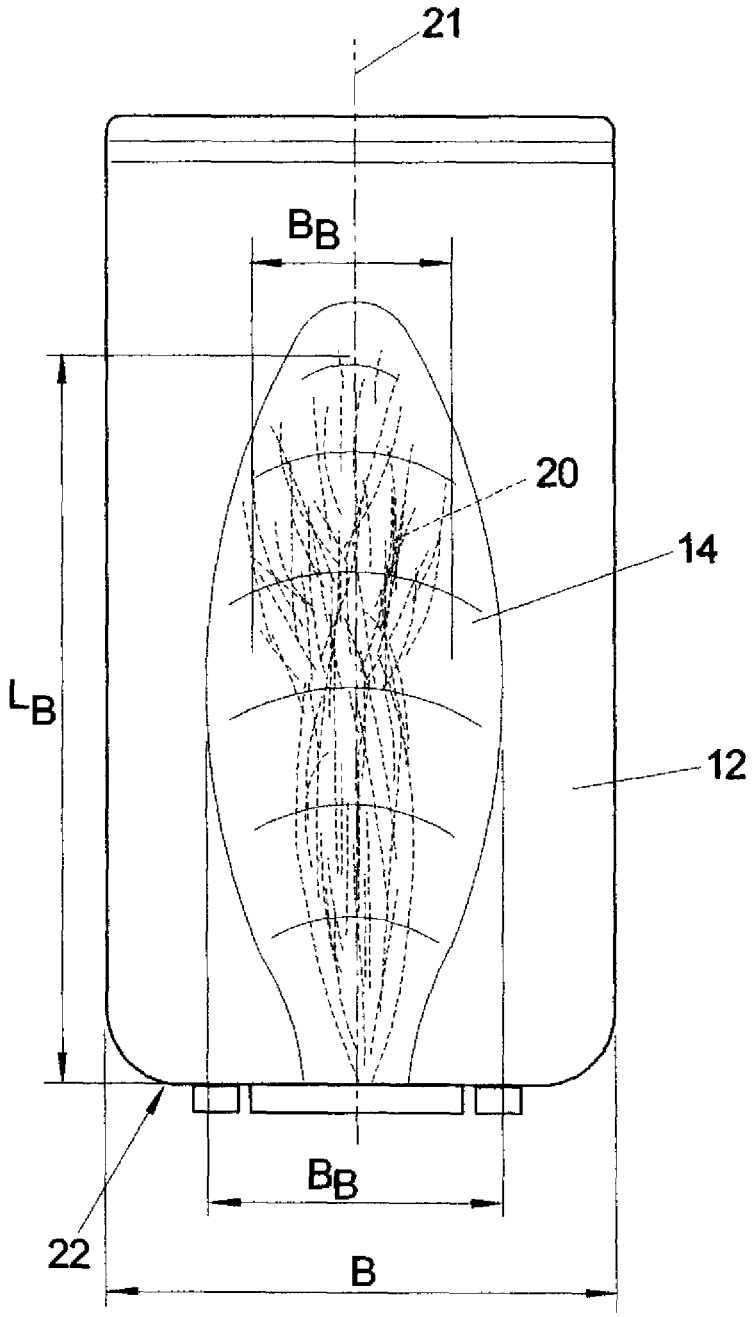
Figure 5:
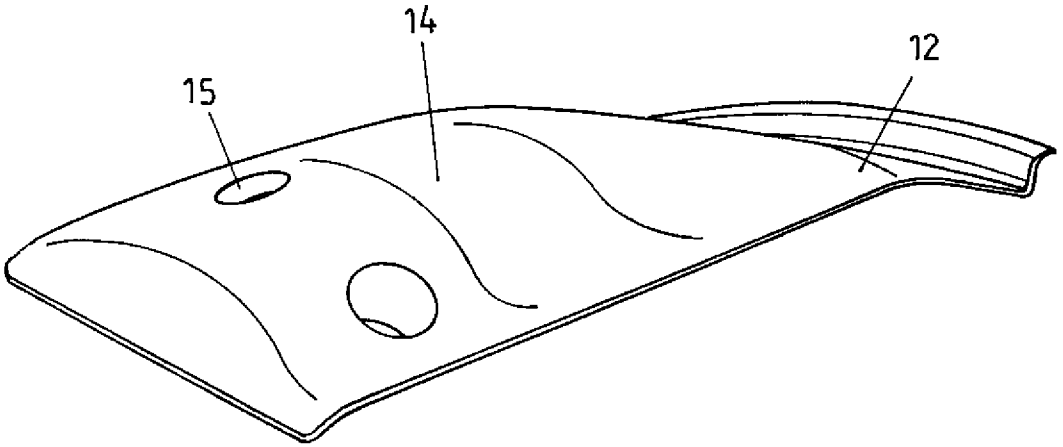
Figure 6A:
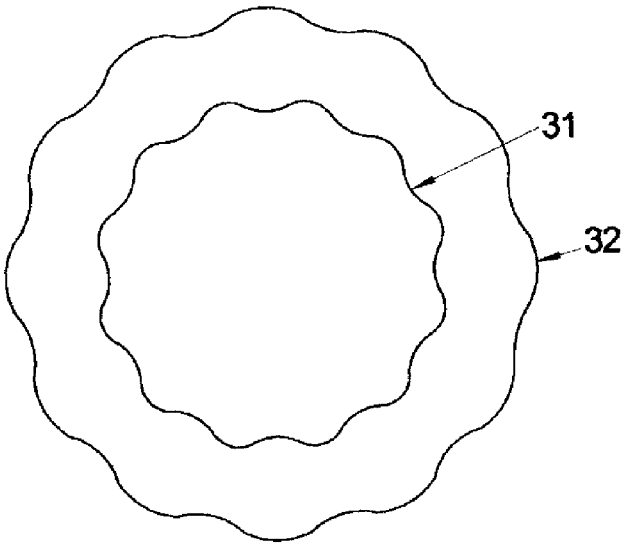
Figure 6B:
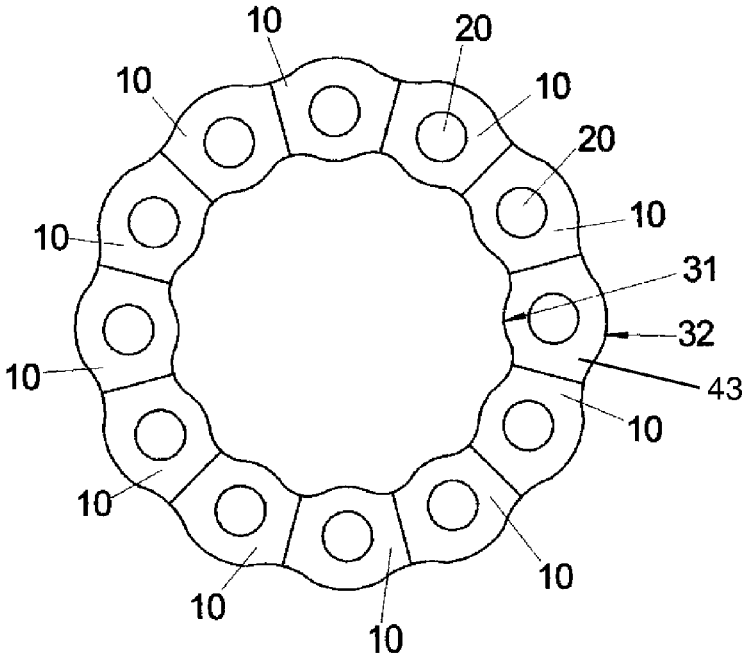

The invention is described in greater detail in the following with reference to the figures of the accompanying drawing showing several exemplary embodiments. In the drawing, FIG. 1 shows a schematic perspective representation of an annular combustion chamber known per se, FIG. 2 shows a perspective representation of an embodiment of a segment component with two combustion-chamber walls for an annular combustion chamber, FIG. 2A shows a view from the combustion-chamber head onto the embodiment as per FIG. 2, FIG. 2B shows a sectional view of the embodiment as per FIG. 2 in the longitudinal direction, FIG. 2C shows a sectional view of the embodiment as per FIG. 2, perpendicularly to the longitudinal direction, FIG. 3 shows an axial sectional view onto an embodiment for an annular combustion chamber formed by segment components in accordance with the embodiment as per FIG. 2, FIG. 4 shows a top view onto a further embodiment of a segment component with two combustion-chamber walls, FIG. 5 shows a further embodiment of a segment component with a combustion-chamber wall, FIG. 6A shows a perspective view of a first stage of an annular space structure, FIG. 6B shows a perspective view of a second stage of an annular space structure.

FIG. 1 shows in a perspective view an annular combustion chamber with an annular space 30, as used for example in an aircraft engine.

The annular space 30 is arranged in the main flow direction of the aircraft engine downstream of the compressor (not shown here) and the intake area of a turbine 40. In the representation of FIG. 1, two injectors 25 are visible, from which fuel flames 20 (not shown here) emanate along burner axes 21 during operation. The burner axes 21 and hence also the fuel flames 20 are thus between the inner combustion-chamber wall 11 and the outer combustion-chamber wall 12. This annular space 30 is also referred to as flame tube. The combustion-chamber walls 11, 12 thus shield the fuel flames 20 inwardly and outwardly from the environment.

The distance between the combustion-chamber walls 11, 12, the annular space height $H_R$ (also referred to as flame space height), varies in the axial direction of the aircraft engine, but is constant along the circumference of the annular combustion chamber 10.

The invention described in the following on the basis of various embodiments relates among others to annular combustion chambers where the annular combustion chamber height $H_R$ is non-constant along the circumference.

An annular combustion chamber of this type is for example made up of at least two segment components 10 of high-temperature casting material. In the case of two segment components, each of the segment components 10 provides for example 180° of the annular space 30.

FIG. 2 shows a segment component 10 covering a considerably smaller angular area, i.e. 30°, as can be discerned particularly clearly from the view of FIG. 2A.

An annular combustion chamber composed of such segment components 10 thus has twelve of these segment components 10. In principle it is possible to design the segment components 10 with a different geometry, so that fewer or more than twelve segment components 10 are used. Here too it is not essential that an even number of segment components 10 is used to form an annular space 30.

FIG. 2 shows an embodiment of a segment component 10 in which parts form the inner combustion-chamber wall 11 and the outer combustion-chamber wall 12 when the segment components 10 are put together (see FIG. 5). An opening 24 for the injector 25 (not shown here) is provided on the combustion-chamber head 22. The fuel flame 20 (not shown here) created with the injector 25 extends along the burner axis 21 into the annular space 30 and in the direction of the intake area of the turbine 40 (not shown here, see FIG. 1).

This embodiment of the segment component 10 is made in one piece from a high-temperature casting material. A superalloy containing nickel, chromium, cobalt and/or nickel-iron can be advantageously used to do so. Typical high-temperature casting alloys are in particular Inconel 738/Inconel 738 LC, Inconel 939/Inconel 939 LC, Inconel 713/Inconel 713 LC, C1023, Mar M 002 and/or CM 274LC. Casting methods (for example precision casting) allow the manufacture of segment components 10 with very thin walls and in very complex shapes.

It is thus for example advantageous when the combustion-chamber walls 11, 12 have a mean thickness between 1 and 4 mm. The wall of the combustion-chamber head 22 can be between 2 and 4 mm. It is for example possible during shaping to integrally cast nozzles 15 for air cooling. It is also possible to cast mounting flanges 23 on the combustion-chamber head 22 in one piece. In principle, the possibilities for shaping are not restricted to the features illustrated.

The combustion-chamber walls 11, 12 of this embodiment are contoured in a specific way: the inner combustion-chamber wall 11 has a bulge 13 which points downward in the representation selected here. The bulge 13 thus points away from the burner axis 21. The outer combustion-chamber wall 12 has an approximately identically shaped bulge 14 upwards. This bulge 14 thus also faces away from the burner axis 21.

The bulges 13, 14 are arranged here such that they approximately correspond to the contour of the fuel flame 20 when the annular combustion chamber is in operation.

These correlations are shown schematically in FIGS. 2B, C, where FIG. 2B shows a longitudinal section through the annular space 30 and FIG. 2C shows a sectional view perpendicularly thereto. In the sectional view of FIG. 2B, the fuel flame 20 is shown schematically, extending from the injector 25 into the annular space 30 over a length $L_B$. The length of the entire annular space is referred to as L. It is advantageous when $L_B$=0.5-0.9 L applies for the length $L_B$ of the fuel flame 20. This means that the fuel flame 20 extends over 50 to 90% of the axial extent of the annular space.

The bulge 13 on the inner combustion-chamber wall 11 and the bulge 14 on the outer combustion-chamber wall 12 reach in the axial direction approximately the distance by which the fuel flame 20 extends into the annular space.

In advantageous embodiments, the axial extent of the bulges 13, 14 is about 50 to 90% of the entire axial extent of the annular space. Furthermore, it is advantageous when the width $B_B$ of the bulges 13, 14 is about 30 to 60% of the width B of a segment component 10, where the width $B_B$ of the bulge on the inside is smaller than on the outside.

FIG. 2C shows the sectional view perpendicularly to the view of FIG. 2B, from which it can also be discerned that the bulges 13, 14 are adapted approximately to the contour of the fuel flame.

In FIG. 20 an area A is shown in which the annular space height $H_{RA}$ is increased by the bulges 13, 14, and an area B in which the annular space height $H_{RB}$ is reduced.

An arc length U of the segment component 10 is thus made up of A+2B. It is advantageous when the proportion of the area A is 50 to 80% of the arc length U and the proportion of the area B is 20 to 50% of the arc length U.

Furthermore, in FIG. 2C the usual radii of the combustion-chamber walls are indicated, i.e. $R_i$ and $R_a$, where it can be discerned that bulges 13, 14 are in part outside of $R_a$ or inside of $R_i$. The usual (conventional) annular space height $H_{konv}$ thus corresponds to $R_a$–$R_i$.

Advantageous embodiments have bulges 13, 14 for which applies: $H_{RA}$=1.1-1.5 $H_{konv}$. This means that the height of the combustion space in the area of the bulges 13, 14 is extended by 10 to 50% compared with the conventional design.

It is also advantageous when in the area B, i.e. in areas without bulges 13, 14, the following applies: $H_{RA}$=0.7-0.9 $H_{konv}$. This means that the height of the combustion space in the area outside the bulges 13, 14 is 70 to 90% of the usual height.

If several of these segment components 10 are now connected to one another, an annular combustion chamber is formed of which the annular space height $H_R$ in the circumferential direction is variable. Segment components 10 are for example connected to one another by laser or electron beam welding, where the energy input per unit length is minimized. A suitable ductile filler can be used for welding (IN625 or Polymet 972).

An annular combustion chamber assembled in this manner is shown in FIG. 3. For reasons of clarity, only six segment components 10 are used here to form an annular space 30. Areas A with a greater annular space height $H_{RA}$ alternate with areas B with a lower annular space height $H_{RB}$ along the circumference, such that the combustion-chamber walls 11, 12 form a kind of wavelike structure.

The fuel flames 20 (not shown here) are in each case in the expanded areas A. Narrowed areas B are located between the fuel flames 20. This leads to each fuel flame 20 being able to burn practically in its own combustion space. Perturbations in one area of the annular space 30 cannot spread so easily inside the entire annular space 30 because of the narrowed sections in the areas B.

Air can also be routed in the areas B between the injectors 25 with less heavy deflection from the compressor to the turbine 40, so that the pressure loss on this flow path drops.

The embodiment described however also has advantageous effects outside the annular space 30, since the turbine cooling air K too, which is routed outside the annular space, is influenced by the contouring of the combustion-chamber walls 11, 12.

Here the pressure loss during the passage of the turbine cooling air K from the compressor outlet past the combustion chamber to the inlet into the cooling system is determined in this way by the flow guidance. If the turbine cooling air K has to be repeatedly (in particular radially) deflected and accelerated (and then decelerated again), then the pressure loss increases. In the burner axis 21, only little turbine cooling air K flows past the burner and the mixed air hole in the direction of the turbine, so the pressure loss there is not so crucial.

Between the burners in the present embodiment, the combustion-chamber head 22 is designed such that the turbine cooling air K is not first heavily deflected radially outwards and inwards. These are the areas B between the bulges 13, 14, but on the respective outer faces of the annular space 30. Radial deflection is followed by a deflection in the axial direction. There is thus in area B a minor deflection into the much deeper annuli around the combustion chamber which is narrower at this point. The flow of turbine cooling air K is schematically shown in FIG. 3.

With appropriate flow guidance, pressure losses are lower. The pressure loss is reduced by the indentation between the burners. Due to the deeper annuli, the turbine cooling air K has, in comparison with the usual gap flow, less contact to the hot combustion-chamber wall and is thus supplied colder to the turbine, which improves the cooling effect inside the turbine.

In all, the total pressure loss can be reduced, lowering the fuel consumption. In addition, less air flows between the injectors 25 into the area of the combustion-chamber head 22 than at the position of the injectors 25, so that sufficient air is available for transfer into the turbine 40 at these circumferential positions.

Moreover, the bulges 13, 14 lead to a more even temperature distribution in the circumferential direction inside the combustion-chamber walls 11, 12, which has a positive effect on the service life of the annular combustion chamber. In the areas A in which the fuel flame 20 is located, the combustion-chamber wall 11, 12 is, due to the bulges 13, 14, relatively far away from the fuel flame 20. In the areas B between the fuel flames 20, the combustion-chamber walls 11, 12 are closer together, since the annular space height $H_R$ is lower here. Without the bulges 13, 14, the wall areas of the combustion-chamber walls 11, 12 closest to the fuel flame 20 would be hotter than other areas. For these reasons, it is not necessary to use so much cooling air in the area A. The cooling air thus saved is available for measures to reduce the exhaust emissions.

As can be discerned in FIG. 3, the inner combustion-chamber wall 11 and the outer combustion-chamber wall 12 have a wavy structure if they are assembled from segment components 10, for example in accordance with FIG. 2. This wavy structure permits an easier compensation for thermal and/or mechanical stresses in the combustion-chamber walls 11, 12 than would be the case in annular spaces with circular cross-sections in the circumferential direction.

If it seems necessary (for example in larger aircraft engines), the segment components 10 can be provided with a thermal barrier coating.

If a ductile filler material is used, it is not necessary, in the case of subsequent laser drilling of the annular combustion chamber, to take account of the positions of longitudinal welds between the segment components 10.

FIG. 4 shows a further embodiment of a segment component 10. In principle it has the same functions and properties as the previously described segment component 10, so that the appropriate description can be referred to.

Unlike the substantially rectangular bulges 13, 14 in the embodiment according to FIG. 2, the bulges 14 here are arranged in the shape of the fuel flame 20 from the combustion-chamber head 22 in the direction of the turbine 40 (not shown here). The bulge 13 has a rather low width in the vicinity of the combustion-chamber head 22, which steadily increases and then decreases again.

In principle, the casting method can also be used to provide other shapes for bulges that can be adapted to a certain intended use. The use of the aforementioned materials and the casting method in particular make it possible to shape the bulges 13, 14 selectively.

FIGS. 2, 3 and 4 show embodiments in which two combustion-chamber walls 11, 12 are opposite. These segment components 10 thus have a substantially U-shaped arrangement, since the combustion-chamber walls 11, 12 are connected by the combustion-chamber head 22 cast in one piece with them.

It is however also possible in principle that a segment component 10 has only an outer or an inner part of the annular combustion chamber. FIGS. 4 and 5 show an embodiment of a segment component 10 having only an outer combustion-chamber wall 12. Like the previously described embodiments, this segment component 10 too has a bulge 14 pointing away from the burner axis 21. To make clear the use of this segment component 10, FIG. 4 shows in dashed lines the fuel flame 20 and the burner axis 21.

With this embodiment too and with a corresponding segment component 10 for the inner combustion-chamber wall 11, an annular combustion chamber can be designed as shown in FIGS. 6A, B.

To do so, at least two segment components 10' are connected, in particular welded, to an inner full ring structure 31. Furthermore, two segment components 10" are connected, in particular welded, to an outer full ring structure 32. FIG. 6A shows the two full ring structures 31, 32 which, for reasons of simplicity, have only six segment components 10. Then the inner full ring structure 31 and the outer full ring structure 32 are connected to a combustion-chamber head structure 43 as shown in FIG. 6B.

LIST OF REFERENCE NUMERALS

10 Segment component
11 Inner combustion-chamber wall
12 Outer combustion-chamber wall
13 Bulge, inner combustion-chamber wall
14 Bulge, outer combustion-chamber wall
15 Nozzle for cooling air
20 Fuel flame
21 Burner axis
22 Combustion-chamber head
23 Mounting flange
24 Device for arrangement of a burner
25 Injector for fuel
30 Annular space
31 Inner full ring structure
32 Outer full ring structure
40 Intake area of turbine
K Turbine cooling air
$H_{RA}$ Area of greater annular space height
$H_{RB}$ Area of lower annular space height
$H_R$ Annular space height
$H_{konv}$ Usual (conventional) annular space height
$R_i$ Radius of inner combustion-chamber wall
$R_a$ Radius of outer combustion-chamber wall
B Width of segment component
$B_B$ Bulge width
$L_B$ Length of fuel flame
L Length of fuel chamber
U Arc length of a segment component

What is claimed is:

1. A segment component in high-temperature casting material for an annular combustion chamber of an aircraft engine, the segment component forming a combustion-chamber wall for shielding a fuel flame extending along a burner axis from the environment;

the combustion-chamber wall having a bulge bulging in a direction away from the burner axis;

the segment component including a combustion-chamber head, and an inner combustion-chamber wall and an outer combustion-chamber wall between which the fuel flame is provided in operation, with the inner combustion-chamber wall, the combustion-chamber head and the outer combustion-chamber wall being connected to one another as a monolithic, U-shaped casting.

2. The segment component of claim 1, wherein at least one chosen from the inner combustion-chamber wall and the outer combustion-chamber wall includes the bulge.

3. The segment component of claim 1, wherein the bulge of the combustion-chamber wall is adapted substantially to a contour of the fuel flame in operation, with at least one chosen from a length of the bulge ($L_B$) and a width of the bulge ($B_B$) corresponding substantially to a respective length and width of the fuel flame in operation.

4. The segment component of claim 1, wherein the high-temperature casting material is a super-alloy containing at least one chosen from nickel, chromium, cobalt, nickel-iron, Inconel 738, Inconel 738 LC, Inconel 939, Inconel 939 LC, Inconel 713, Inconel 713 LC, C1023, Mar M 002, and CM 274LC.

5. The segment component of claim 4, and further comprising at least one chosen from a mounting flange and a device for arranging an injector is provided on the combustion-chamber head.

6. The segment component of claim 1, and further comprising at least one nozzle for cooling air integrally formed onto a combustion-chamber wall.

7. The segment component of claim 1, wherein the combustion-chamber wall has a mean thickness between 1 and 4 mm.

8. The segment component of claim 7, wherein the combustion-chamber wall has a mean thickness between 1.4 to 3 mm.

9. An annular combustion chamber for an aircraft engine, comprising:

at least two segment components, each segment component in high-temperature casting material for an annular combustion chamber of an aircraft engine, the segment component forming a combustion chamber wall which in operation shields a fuel flame extending along a burner axis from the environment;

the combustion-chamber wall having a bulge bulging in a direction facing away from the burner axis;

each segment component including a combustion-chamber head, and an inner combustion-chamber wall and an outer combustion-chamber wall between which the fuel flame is provided in operation, with the inner combustion-chamber wall, the combustion-chamber head and the outer combustion-chamber wall being connected to one another as a monolithic, U-shaped casting.

10. The annular combustion chamber in accordance with claim 9, and further comprising a varying annular space height along a circumference of an annular space between the inner combustion-chamber wall and the outer combustion-chamber wall with areas having a greater annular space height alternating with areas having a lower annular space height along the circumference.

11. The annular combustion chamber in accordance with claim 9, and further comprising a varying annular space height along a circumference of an annular space between the inner combustion-chamber wall and the outer combustion-chamber wall with areas having a greater annular space height and areas having a lower annular space height, with injectors for the fuel being provided in the areas with the greater annular space height.

12. An aircraft engine including an annular combustion chamber in accordance with claim 9.

13. A method for manufacturing an annular combustion chamber for an aircraft engine, comprising:

casting each of at least two segment components from a high-temperature casting material, each of the at least two segment components including an inner combustion-chamber wall, an outer combustion-chamber wall and a combustion-chamber head portion connected to one another as a monolithic, U-shaped casting, with at least one chosen from the inner combustion-chamber wall and the outer combustion-chamber cast to include a bulge bulging in a direction facing away from a burner axis;

subsequently welding the at least two segment components together to form the annular combustion chamber.

14. The method of claim 13, wherein the segment components are connected to one another by at least one chosen from electron beam welding and laser welding.

15. The method of claim 14, wherein the welding is performed with at least one chosen from IN626 filler, Polymet 972 and other ductile filler materials.

* * * * *